United States Patent [19]

Uram

[11] Patent Number: 4,576,219

[45] Date of Patent: Mar. 18, 1986

[54] MOLTEN METALS FILTER APPARATUS

[75] Inventor: Stuart Z. Uram, Alpine, N.J.

[73] Assignee: Certech Incorporated, Wood-Ridge, N.J.

[21] Appl. No.: 435,980

[22] Filed: Oct. 22, 1982

[51] Int. Cl.[4] ..... B22C 9/08

[52] U.S. Cl. ..... 164/358; 164/134; 222/189; 210/485

[58] Field of Search ..... 164/358, 362, 134, 133; 222/189; 210/470, 471, 485, 773

[56] References Cited

U.S. PATENT DOCUMENTS

| | | | |
|---|---|---|---|
| 1,294,742 | 2/1919 | Wolff | 164/337 |
| 1,298,034 | 3/1919 | Gathmann | 239/542 |
| 1,657,952 | 4/1926 | Zoda | 164/358 |
| 2,451,505 | 10/1948 | Myskowski et al. | 164/358 |
| 2,757,425 | 8/1956 | Duncan et al. | 164/134 |
| 2,835,007 | 5/1958 | Hoefer | 164/358 |
| 2,962,778 | 12/1960 | Peak | 164/437 |
| 3,516,478 | 6/1970 | Dunn et al. | 164/423 |
| 3,667,534 | 6/1972 | Kanokogi et al. | 164/478 |
| 3,815,661 | 6/1974 | Curran et al. | 164/358 |
| 3,995,682 | 12/1976 | Fekete et al. | 164/437 |
| 4,209,162 | 6/1980 | Petiau | 164/362 |
| 4,303,525 | 12/1981 | Stover | 210/470 |

*Primary Examiner*—Nicholas P. Godici
*Assistant Examiner*—Kurt Rowan
*Attorney, Agent, or Firm*—Amster, Rothstein & Engelberg

[57] ABSTRACT

A molten metals filter apparatus having a hollow frusto-conical strainer, including an inlet port and a plurality of slot apertures having a uniform width for selectively restraining particulant impurities in molten metals.

5 Claims, 6 Drawing Figures

FIG. 4
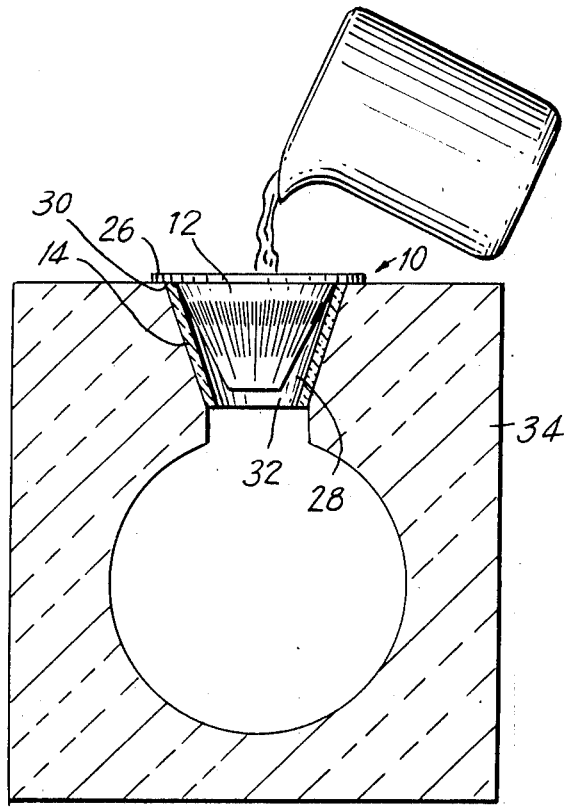
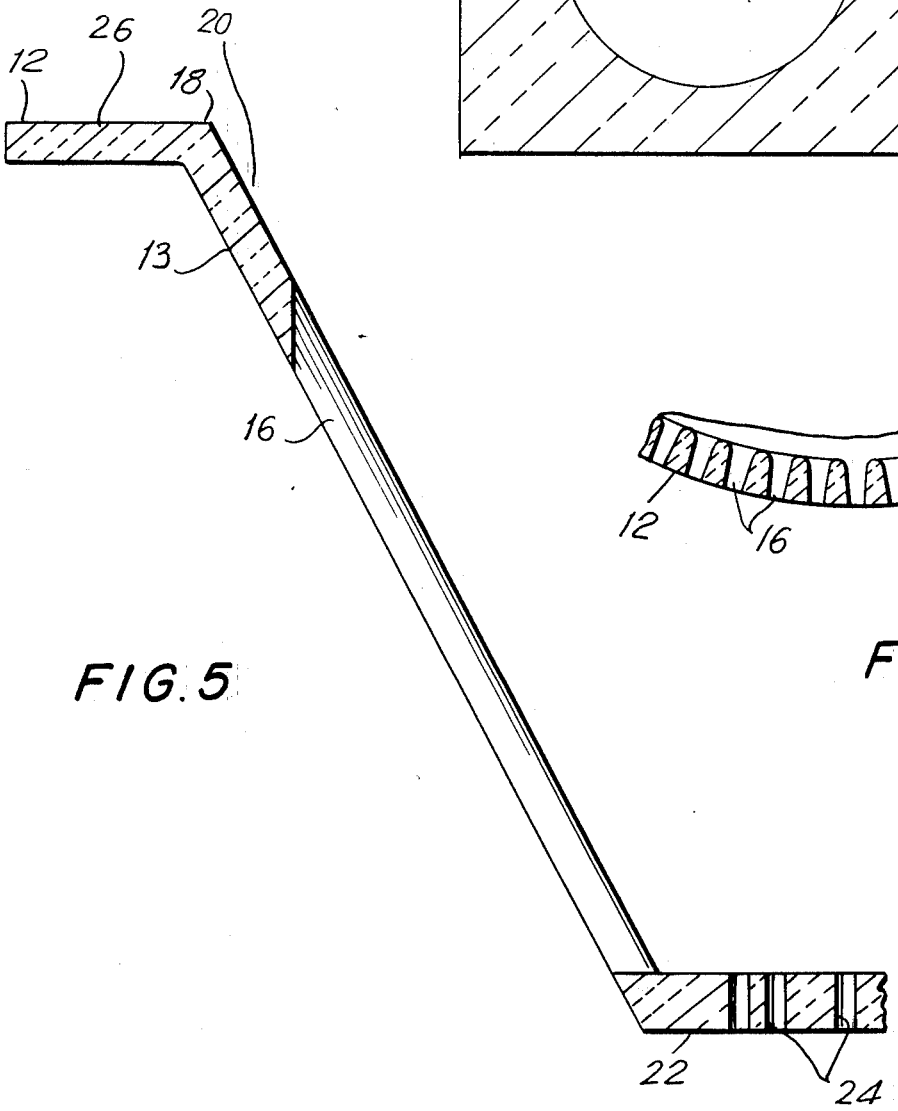
FIG. 5
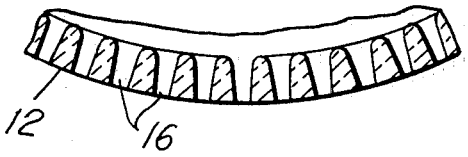
FIG. 6

MOLTEN METALS FILTER APPARATUS

BACKGROUND OF THE INVENTION

This invention relates to an apparatus for filtration of molten metals, and in particular, to such an apparatus adapted for filtration of molten metals as they are poured into a mold. More specifically, this invention relates to a hollow frusto-conical strainer having a plurality of slot apertures of uniform width for separating particulant impurities from the molten metal. The strainer may rest within a pour cup having an outlet port which mates with the inlet port of a mold. The slot apertures are disposed longitudinally about the conical surface of the strainer and are of staggered lengths so that there are relatively fewer slots extending to the smaller diameter portion of the strainer than extending to the larger diameter portion of the strainer. The bottom of the strainer has a plurality of apertures of a size substantially equal to the width of the slot apertures. The top of the strainer is open and has a flange disposed about its perimeter which abuts the lip of the pour cup. The strainer and the pour cup are made of refractory or ceramic material of sufficient heat resistance and strength to withstand the heat and thermal shock of molten metal.

Filters for molten metal have long been known in the art, but their usefulness has been limited by their substantial restriction of metal flow rate, the difficulties encountered in their use and/or their tendency to introduce unwanted foreign material into the mold. Presently used filters generally consist of disk-like members which are cemented or grouted into the inlet port of the mold. Unless the cementing or grouting is done with extreme care, it is possible for the molten metal to bypass and flow around the filter element. Further, during insertion, the grout or cement material may enter the mold as fine particles which cannot be removed once the filter is in place. Accordingly, nonmetallic inclusions can be trapped inside the mold and contaminate the casting. Three types of disk-like filters are commonly used. The first, known as a strainer core, is made by pressing a plate of ceramics with a series of holes. Because of the limitation of the pressing process, it is usually not possible to obtain greater than a 50 percent open area of holes. This results in a large restriction of metal flow making a strainer core unsuitable for investment castings. The second type of filter is a ceramic foam having an open cell structure. As in the case of a strainer core, this type of filter cannot be used for investment casting, since the flow restriction is too great. The third type of filter has a screen-like appearance and is made by extruding ceramic. The open area can be as high as 70 percent, and accordingly, this type of filter has become popular in investment casting. However, because this product is flat and light, the limitations inherent in cementing or grouting the filter into the mold inlet port as described above preclude its full acceptance.

SUMMARY OF THE INVENTION

The present invention overcomes the limitations associated with prior art molten metal casting filters by providing an apparatus including a hollow frustroconical strainer having a plurality of slot apertures of uniform width which either rests within a pour cup having an outlet port adapted to mate with an inlet port of a mold or rests directly within the inlet port of the mold.

Since the strainer means, much like a funnel, is frusto-conically shaped and rests either within a pour cup or directly within the inlet port of the mold, there is no necessity to cement or grout the strainer into the inlet port, and accordingly, there is no danger of cement or grout invading the mold or of molten metal bypassing the strainer. By providing a plurality of slot-shaped apertures and by the use of a frusto-conical shape having a high surface area, the strainer has a high open area and permits relatively free flow of the molten metal through the strainer.

Accordingly, it is an object of the present invention to provide an improved filter for molten metal which is adapted for use at the inlet port of a mold and which obviates one or more of the disadvantages of the prior art and produces improved results.

It is a further object of the present invention to provide a molten metal filter apparatus which may be utilized without the necessity of cementing or grouting the filter onto a mold.

It is still a further object of this invention to provide a molten metal filter apparatus having a high open area to permit the relatively uninhibited flow of molten metal through the filter.

It is yet a further object of the present invention to provide a molten metal filter apparatus which is suitable for use in investment casting.

In accordance with the present invention, there is provided a refractory or ceramic hollow frusto-conical strainer having an inlet port and a plurality of slot apertures of uniform width about its conical surface. In a particular illustrative embodiment demonstrating the objects and features of the present invention, the slot apertures are disposed longitudinally and are of staggered lengths so that there are relatively fewer slots extending to the larger diameter portion of the strainer than to the small diameter portion of the strainer. The bottom or smaller end of the strainer has a plurality of apertures of a size substantially equal to the width of the slot apertures. The strainer may be used in association with a pour cup at the inlet port of a mold. The top or larger end of the strainer is fully open and may have a flange disposed about its perimeter to aid in positioning the strainer.

BRIEF DESCRIPTION OF THE DRAWINGS

The above objects, aspects and advantages of the invention, as well as others, will be apparent from the detailed description of the preferred embodiment of the invention considered in conjunction with the drawings, which should be considered in an illustrative and not in a limiting sense, as follows:

FIG. 4 is a side elevational view in partial section showing the pour cup in place on a mold while molten metal is being poured;

FIG. 5 is a cross section of the frusto-conical strainer taken on line 5—5 of FIG. 1; and FIG. 6 is a cross section of the frusto-conical strainer taken on line 6—6 of FIG. 2.

DETAILED DESCRIPTION OF THE PREFERRED EMBODIMENT OF THE INVENTION

Figure 1:
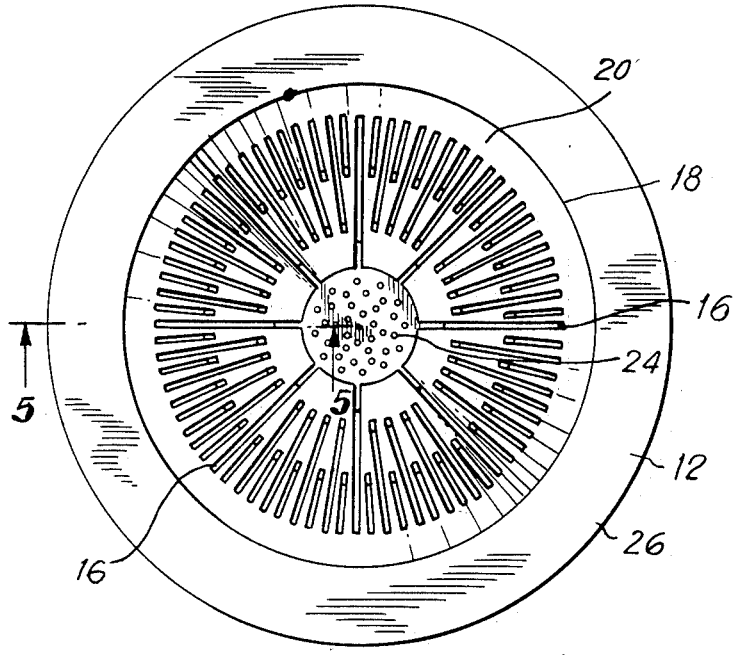
FIG. 1 is a top plan view of the hollow frusto-conical strainer showing the slot apertures, inlet port, bottom apertures and flange.
Figure 2:
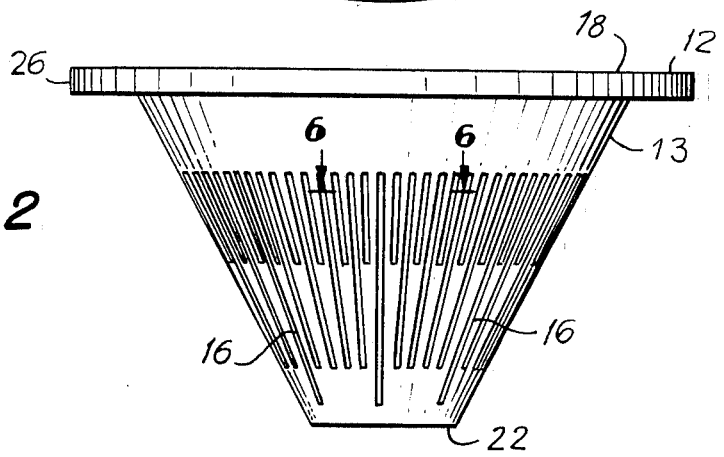
FIG. 2 is a side elevational view of the frusto-conical strainer of FIG. 1.
Figure 3:
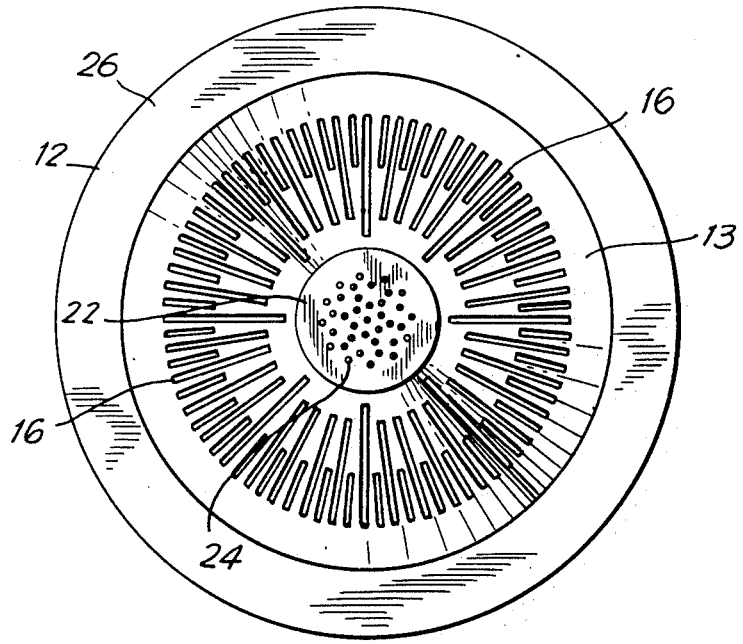
FIG. 3 is a bottom plan view of the frusto-conical strainer of FIG. 1.

Referring to FIGS. 1 and 2, a frusto-conical strainer 12 including a conical surface 13 having a plurality of slot apertures 16, an open top end 18 having an inlet port 20, a bottom end 22 having a plurality of apertures 24 and a flange 26 disposed about the perimeter of the top end 18 is shown.

The slot apertures 16 extend longitudinally about the conical surface 13 of the frusto-conical strainer 12 and are of staggered length so that there are relatively fewer slots which extend to the smaller diameter portion of the frusto-conical strainer 12 than which extend to the larger diameter portion of the frusto-conical strainer 12. By so staggering the slot apertures 16, a maximum number may be included in the conical surface 13 of the frusto-conical strainer 12 while providing such slot apertures 16 with a uniform width. The bottom apertures 24 in the bottom end 22 have a size substantially equal to the uniform width of the slot apertures 16. The bottom apertures 24 are easily formed in circular configuration and may take other shapes as well, such as similar to the slot apertures 16. Although any suitable dimensions may be utilized, it is found that a dimension of approximately 0.05 inches is appropriate for straining most molten metals. Since, by far, the greatest portion of contaminant material in molten metal is generally spherical and not rod-like, use of slot openings rather than circular openings substantially increases the total flow area without materially decreasing the filtering effect of the device.

Referring to FIG. 4, it is seen that the frusto-conical strainer 12 may be used in association with a pour cup 14 so that the flange 26 of the frusto-conical strainer 12 abuts against the upper lip 30 of the pour cup 14. The pour cup 14 is dimensioned such that there is a chamber 28 between the conical surface 13 of the frusto-conical strainer 12 and the inner surface of the pour cup 14 through which metal may flow. The pour cup 14 has an outlet port 32 through which the strained molten metal may exit.

As seen in FIG. 4, in use, a strainer and pour cup assembly 10 is seated upon a mold 34 having an inlet port 36, so that the outlet port 32 of the pour cup 12 engages the inlet port 36 of the mold 34. Molten metal is poured through the inlet port 20 of the frusto-conical strainer 12 and flows through the slot aperture 16 and circular apertures 24 into the chamber 28 of the pour cup 12 and out of the outlet port 32. Particulant impurities having dimensions larger than the width of the slot apertures 16 are restrained within the frusto-conical strainer 12.

The frusto-conical strainer 14 and pour cup 12 may be made of any material, particularly ceramic or refractory materials, having sufficient heat resistance and strength to withstand the heat and shock of poured molten metal. For example, the frusto-conical strainer 14 and pour cup 12 may be made of fused silica and zircon, alumina, alumina silicates, or zirconia. The frusto-conical strainer 12 is preferably manufactured by injection molding. Accordingly, as seen in FIG. 6, the slot aperture 16 may be tapered for ease of molding. Alternatively, the frusto-conical strainer may be manufactured by slip casting or pressing.

It should be understood that the embodiment described herein is only illustrative of the present invention, and it should be recognized by those skilled in the art that, for example, the invention may also be practiced with slot apertures running on a bias, or in other configurations. Accordingly, a latitude of modification, change and substitution is intended in the foregoing disclosure. Accordingly, it is appropriate that the appended claims be construed broadly and in a manner consistent with the spirit and scope of the invention.

What I claim is:

1. A molten metal filter apparatus comprising: a hollow frusto-conical strainer means for selectively restraining particulant impurities in molten metal, said strainer means having a plurality of slot apertures disposed longitudinally about its conical surface and an inlet port, said slot apertures being of uniform width and of staggered lengths so that there are relatively fewer slots which extend to the smaller diameter portion of said strainer means than which extend to the larger diameter portion of said strainer means.

2. A molten metal filter apparatus comprising: a hollow frusto-conical strainer means for selectively restraining particulant impurities in molten metal, said strainer means having a plurality of slot apertures disposed longitudinally about its conical surface and an inlet port, the bottom of said strainer means having a plurality of bottom apertures of a size substantially equal to the width of said slot aperatures.

3. A molten metal filter apparatus, as claimed in claim 2 wherein:

said bottom apertures are circular.

4. A molten metal filter apparatus, as claimed in claims 1 or 2, wherein:

said apparatus is made of refractory material.

5. A molten metal filter apparatus, as claimed in claims 1 or 2, wherein:

said apparatus is made of ceramic material.

* * * * *